US006746007B2

(12) United States Patent
DaCunha et al.

(10) Patent No.: US 6,746,007 B2
(45) Date of Patent: Jun. 8, 2004

(54) METHOD AND APPARATUS FOR CONTROLLING ENCLOSURE MATERIAL FEEDING IN A MAIL INSERTING SYSTEM

(75) Inventors: Steven J. DaCunha, West Hartford, CT (US); Gregory P. Skinger, Southbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 2 days.

(21) Appl. No.: 10/280,143

(22) Filed: Oct. 25, 2002

(65) Prior Publication Data

US 2004/0080091 A1 Apr. 29, 2004

(51) Int. Cl.[7] ..... B43M 3/04

(52) U.S. Cl. ..... 270/58.02; 270/58.03; 270/52.15; 198/718; 198/464.3

(58) Field of Search ..... 270/58.02, 58.03, 270/52.15, 52.16, 58.06; 198/718, 464.3

(56) References Cited

U.S. PATENT DOCUMENTS 3,547,254 A * 12/1970 Manetta ..... 198/718
3,656,738 A * 4/1972 Glaser et al. ..... 270/58.03
3,844,400 A * 10/1974 Dehne ..... 198/795
4,177,979 A * 12/1979 Orsinger et al. ..... 270/52.16
4,732,261 A * 3/1988 Mattern et al. ..... 198/431
5,326,087 A * 7/1994 Colson et al. ..... 270/58.02
5,511,769 A * 4/1996 Wamsley et al. ..... 270/58.26
5,876,029 A * 3/1999 Wright et al. ..... 271/3.18
5,957,263 A * 9/1999 Espenschied ..... 198/349.95
6,237,908 B1 * 5/2001 Chang et al. ..... 270/52.15

FOREIGN PATENT DOCUMENTS

EP 1065074 A2 * 1/2001 ..... B43M/3/04

* cited by examiner

*Primary Examiner*—Patrick Mackey
(74) *Attorney, Agent, or Firm*—Michael J. Cummings; Charles R. Malandra, Jr.; Angelo N. Chaclas

(57) ABSTRACT

A collating system having a plurality of feeders to release enclosure materials onto a deck and a plurality of pusher finger pairs moving along the deck for collating the released materials. The pusher finger pairs are mounted on a pair of moving belts at pre-determined positions. A sensing device is used to monitor whether any pusher finger is missing, broken or out of alignment, thereby rendering a pusher finger pair non-functioning. If a pusher finger pair is not functioning, the cell or pocket associated with that pusher finger pair will be marked "damaged" so that the feeders release enclosure materials only to the cells associated with functional pusher finger pairs.

13 Claims, 7 Drawing Sheets

METHOD AND APPARATUS FOR CONTROLLING ENCLOSURE MATERIAL FEEDING IN A MAIL INSERTING SYSTEM

TECHNICAL FIELD

The present invention relates generally to a mail inserting system and, more particularly, to the document releasing and collating section of a mail inserting system.

BACKGROUND OF THE INVENTION

In a typical mailing inserting system, a plurality of enclosure or input document feeders are used to release enclosure documents onto a chassis or deck. The released documents are gathered, collated and pushed by a plurality of pusher fingers toward the downstream end of the chassis for envelope insertion. Mail inserting systems are known in the art. For example, Roetter et al. (U.S. Pat. No. 4,169,341) discloses a mail inserting system consisting of a document collation section and an envelope insertion section, wherein a plurality of document feeders are used to release documents onto a continuous conveying mechanism that collects and collates the documents and then conveys the collated documents to the envelope insertion section in a continuous manner. Such a mail inserting system is shown in FIG. 1. As shown in FIG. 1, the mail inserting system 1 has an envelope insertion section 8 and a document release and collation section 10 having an upstream end 102 and a downstream end 104. The envelope insertion section 8 is located adjacent to the downstream end 104, where an envelope feeder 14 is used to feed envelopes 12 onto an envelope insertion area 106. In the document releasing and collation section 10, a plurality of enclosure feeders 20 are used to feed enclosure documents 22 onto a chassis or deck 26. The released documents 22 are gathered, collated and pushed downstream by a plurality of pushed finger pairs 40 mounted on two chains or belts 42, as shown in FIG. 2. The belts 42 carry the pusher finger pairs 40 from the upstream end 102 to the downstream end 104 of the document release and collation section 10, whereby the collated documents are conveyed to the envelope insertion area 106 for envelope insertion. The belts 42 move in synchronism with each other so that the pusher fingers in each pair 40 are also moved in synchronism with each other. Advantageously, the belts 42 also move in constant speed so that the enclosure feeders 20 can release the documents in synchronism with the approaching pusher finger pairs 40. Each enclosure feeder 20 has a plurality of rollers 24 for releasing the documents, one at a time. The rollers 24 of the enclosure feeder 20 can be under the control of a central enclosure feeder control module 70 (see FIG. 4). If there are M enclosure feeders 20 that are actually used in the mail inserting system and each of the feeders 20 releases one document to each approaching pusher finger pair 40, then each pusher finger pair 40 will gather and collate a total of M enclosure documents from the upstream end 102 to the downstream end 104.

If one or two pusher fingers in a pair 40 in the document release and collation section 10 are missing, broken, loose or otherwise defective, they may not be able to push and collate the enclosure documents normally. Consequently, paper jams may occur. If an operator of the mail inserting system notices this mishap in time, the operator can halt the operation and repair the defective pusher fingers. Thus, a paper jam can be averted. Even so, the halting of the machine for pusher finger repair causes a disruption of the mailing operation. Production mailing machinery is designed to have uninterrupted availability to maximize throughput of the mailing operation. Repairs count against throughput by making the machine unavailable during the repair.

It is advantageous and desirable to provide a method and system for controlling the releasing and collating of documents in a mail inserting system so as to minimize the disruption to the mailing operation due to non-functioning pusher fingers.

SUMMARY OF THE INVENTION

A typical mail inserting system, such as that shown in FIG. 1, comprises a large number of pusher finger pairs. For example, there are 46 such pairs fixedly mounted on the belts. If all of them are functioning properly, then 46 pusher finger pairs are available for document gathering and collating in one cycle. If one of the pairs is not functioning, it only affects 2.2 percent of the production throughput per cycle. Thus, it is advantageous and desirable to take this non-functioning pusher finger pair out of the operation while using all remaining pusher finger pairs to gather and collate the release documents. So long as the non-functioning pusher finger pair does not impair the operation of the mail inserting system, it will be ignored in that it is not used for document gathering and collating. At the end of mail operation, the customer of the mail inserting system may decide to repair the non-functioning pusher finger pair or keep operating the system with a slightly reduced throughput.

Thus, according to the first aspect of the present invention, there is provided a collation system for collating generally flat items. The system comprises:

an upstream end;

a downstream end;

a deck extending from the upstream end to the downstream end;

a plurality of feeders, each positioned relative to the deck so as to be able to release the items onto the deck;

a continuous moving member running from the upstream end toward the downstream end;

a plurality of pusher pairs mounted on the moving member, each pair disposed in a pre-determined position and associated with a section of the moving member in front of said pair for pushing from the upstream end to the downstream end the items released into said section by the feeders; and a sensing mechanism for sensing the position of the pusher pairs in order to determine whether a pusher pair is functional as to said pushing based on the sensed position of said pusher pair, so that the feeders release the items only onto the sections of the moving member associated with functional pusher pairs.

According to the second aspect of the present invention, there is provided a method of improving the performance of a collation system for collating generally flat items, wherein the collation system comprises:

an upstream end;

a downstream end;

a deck extending from the upstream end to the downstream end;

a plurality of feeders positioned relative to the deck so as to be able to release the items onto the deck;

a continuous moving member running from the upstream end toward the downstream end;

a plurality of pusher pairs mounted on the moving member, each pair disposed in a pre-determined position and associated with a section of the moving member in front of said pair for pushing from the upstream end to the downstream end the items released into said section by the feeders. The method comprises the steps of:

sensing the position of the pusher pairs;

determining whether the pusher pairs are functional as to said pushing based on the sensed positions; and releasing the items only onto the sections of the moving member associated with functional pusher pairs.

According to the third aspect of the present invention, there is provided a mail inserting system for inserting enclosure materials into envelopes for mailing. The system comprises:

an envelope insertion section for providing the envelopes for insertion;

a collation section for collating the enclosure materials, the collation section having:

an upstream end, a downstream end adjacent to the envelope insertion station, a deck extending from the upstream end to the downstream end, a plurality of feeders, each positioned relative to the deck so as to be able to release the enclosure materials onto the deck, a continuous moving member running from the upstream end toward the downstream end, and a plurality of pusher pairs mounted on the moving member, each pair disposed in a pre-determined position and associated with a section of the moving member in front of said pair for pushing from the upstream end to the downstream end the enclosure materials released into said section by the feeders so as to convey the pushed enclosure materials to the envelope insertion section for insertion; and a sensing mechanism, positioned relative to the deck of the collation section, for sensing the position of the pusher pairs in order to determine whether a pusher pair is functional as to said pushing based on the sensed position of said pusher pair, so that the feeders release the enclosure materials only on the sections of the moving member associated with functional pusher pairs.

The present invention will become apparent upon reading the description taken in conjunction with FIGS. 3 to 7.

BEST MODE TO CARRY OUT THE INVENTION

Figure 3:
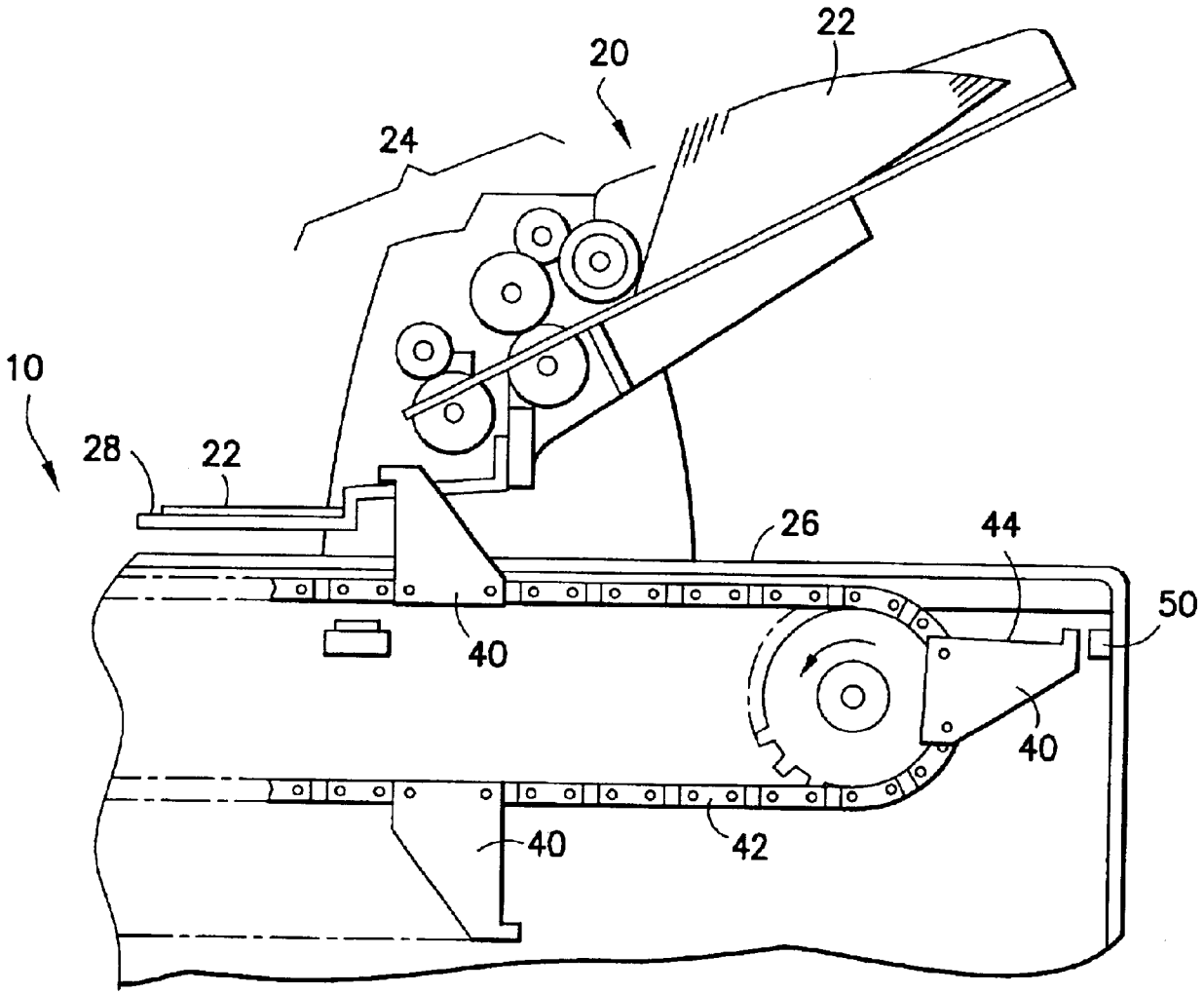
FIG. 3 is a schematic representation showing a section of the mail inserting system, according to the present invention.
Figure 4:
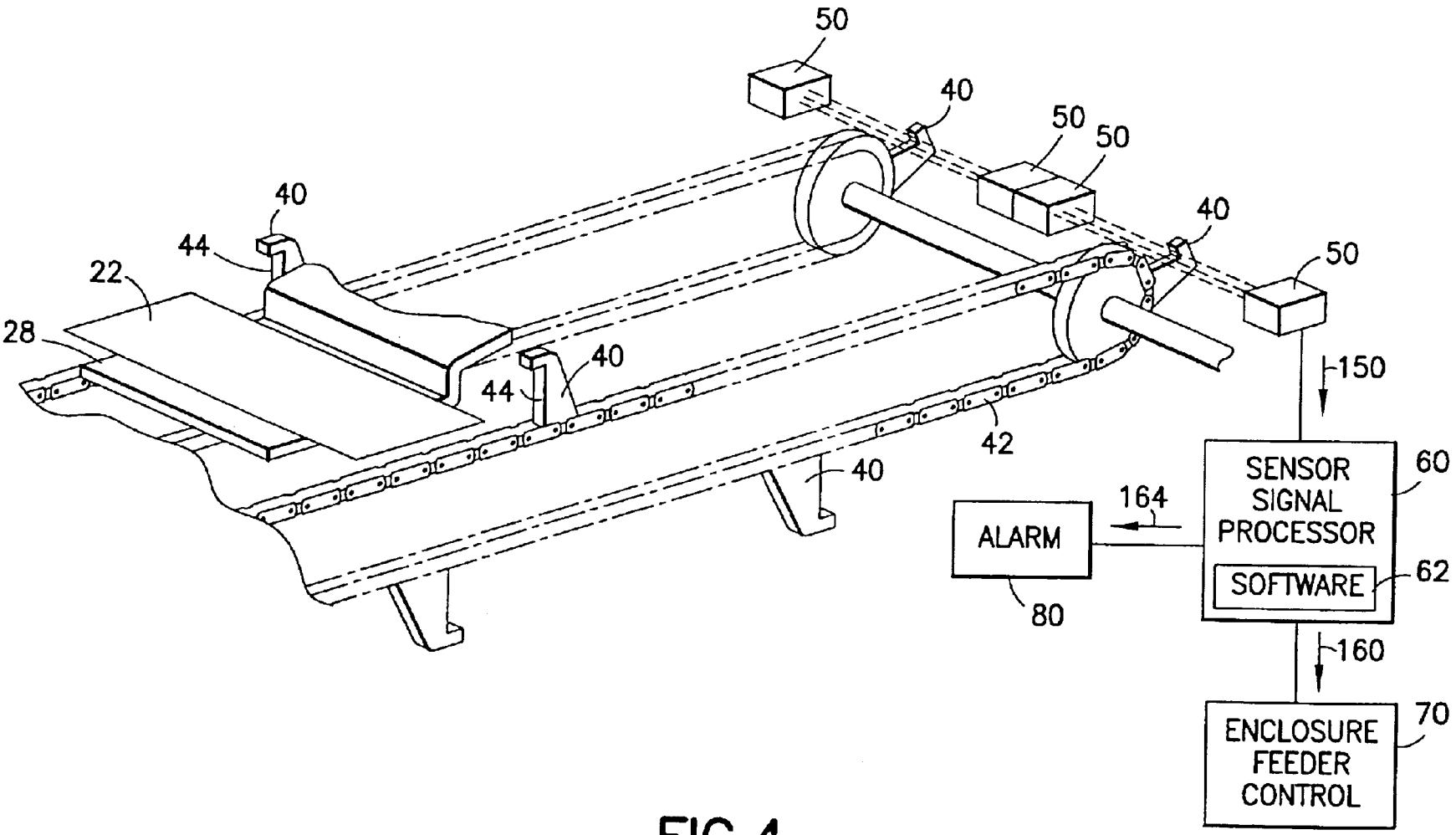
FIG. 4 is a schematic representation showing a sensing device in the mail inserting system, according to the present invention.

FIG. 3 is a schematic representation showing part of the document release and collation section 10 of a mail inserting system, according to the present invention. As shown, the present invention uses a sensing device 50 to check whether one or both pusher fingers in a pusher finger pair are positioned such that it cannot properly gather and collate a stack of enclosure documents toward the envelope insertion section of the mail inserting system. For example, the sensing device 50 can be used to determine whether any one of the pusher fingers 40 on the each belt 42 is missing, whether the edge 44 of each pusher finger 40 is tilted with regard to the normal surface of the deck 26, or whether the edge 44 of one pusher finger 40 becomes misaligned relative to the edge 44 of the other pusher finger 40 in the same pair. There are many different types of sensing devices that can be used for sensing of position and alignment. For example, one may choose to use an array of Hall-effect sensors, magnetic position sensors, capacitive proximity sensors, actuation position sensors, photoelectric sensors or the like. For example, a sensing device 50 consists of two photoelectric sensor pairs. The sensor pairs are fixedly positioned relative to the deck 26 on two sides of each belt 42 to monitor the arrival of the edge 44 of each pusher finger 40 of the same pair, as shown in FIG. 4. Preferably, the sensor pairs are disposed at the upstream end before the first of the enclosure feeders 20. Ideally, the two edges 44 of each pusher finger pair 40 pass the sensing device 50 at substantially the same time in order for the pair 40 to function properly. A sensing signal 160 from the sensing device 50 is then conveyed to a sensor signal processor 60, which uses a software program 62 to determine whether the pusher finger pair 40 passing the sensing device 50 will be used for gathering and collating purposes. The sensor signal process 60 is adapted to sense a signal 160 to an enclosure feeder control 70, which is operatively connected to the feeders 20 to control the rollers 24, such that documents will not be released by the rollers 24 to a non-functioning pusher finger pair 40.

Figure 1:
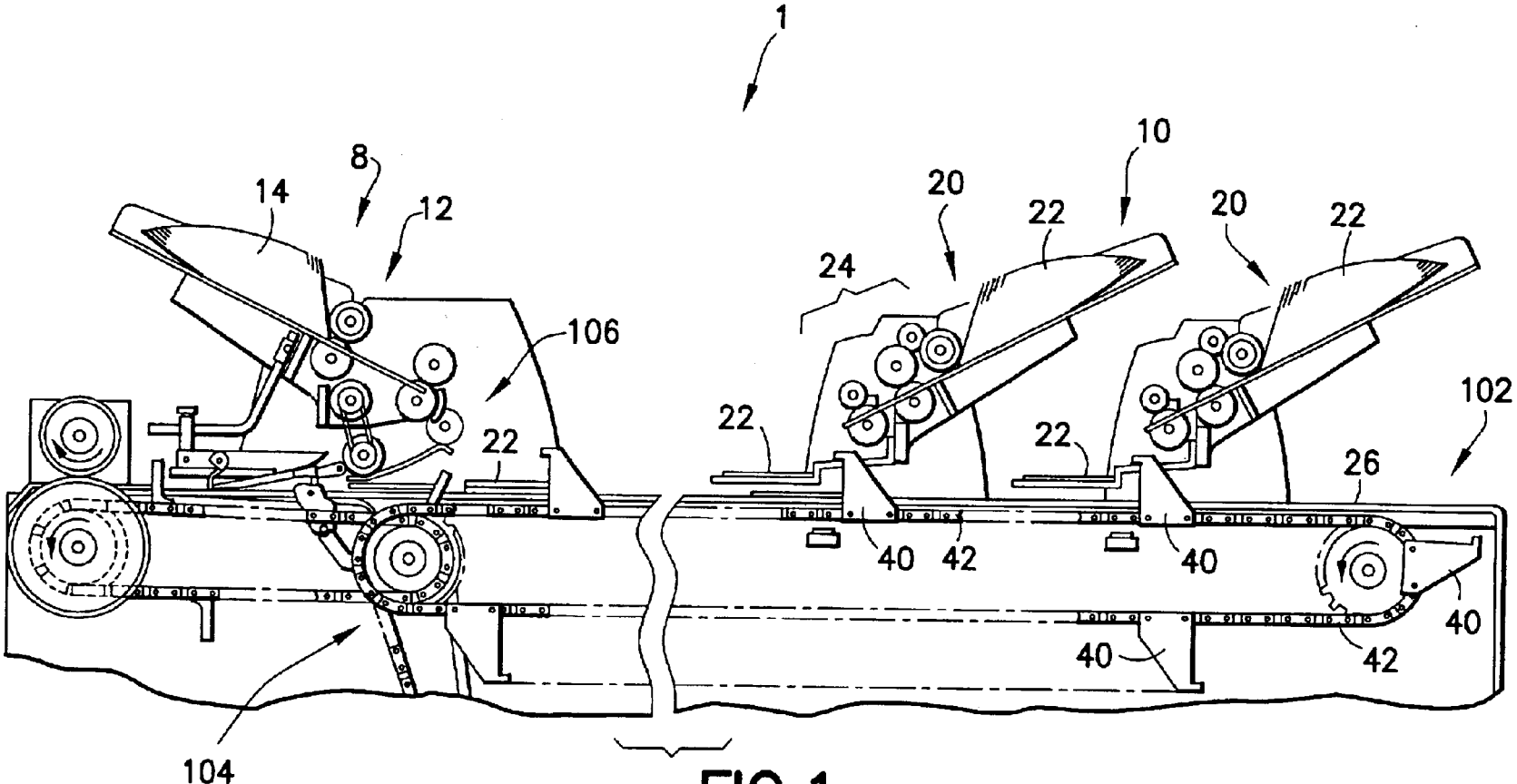
FIG. 1 PRIOR ART
FIG. 1 is a schematic representation showing a typical mail inserting system.
Figure 2:
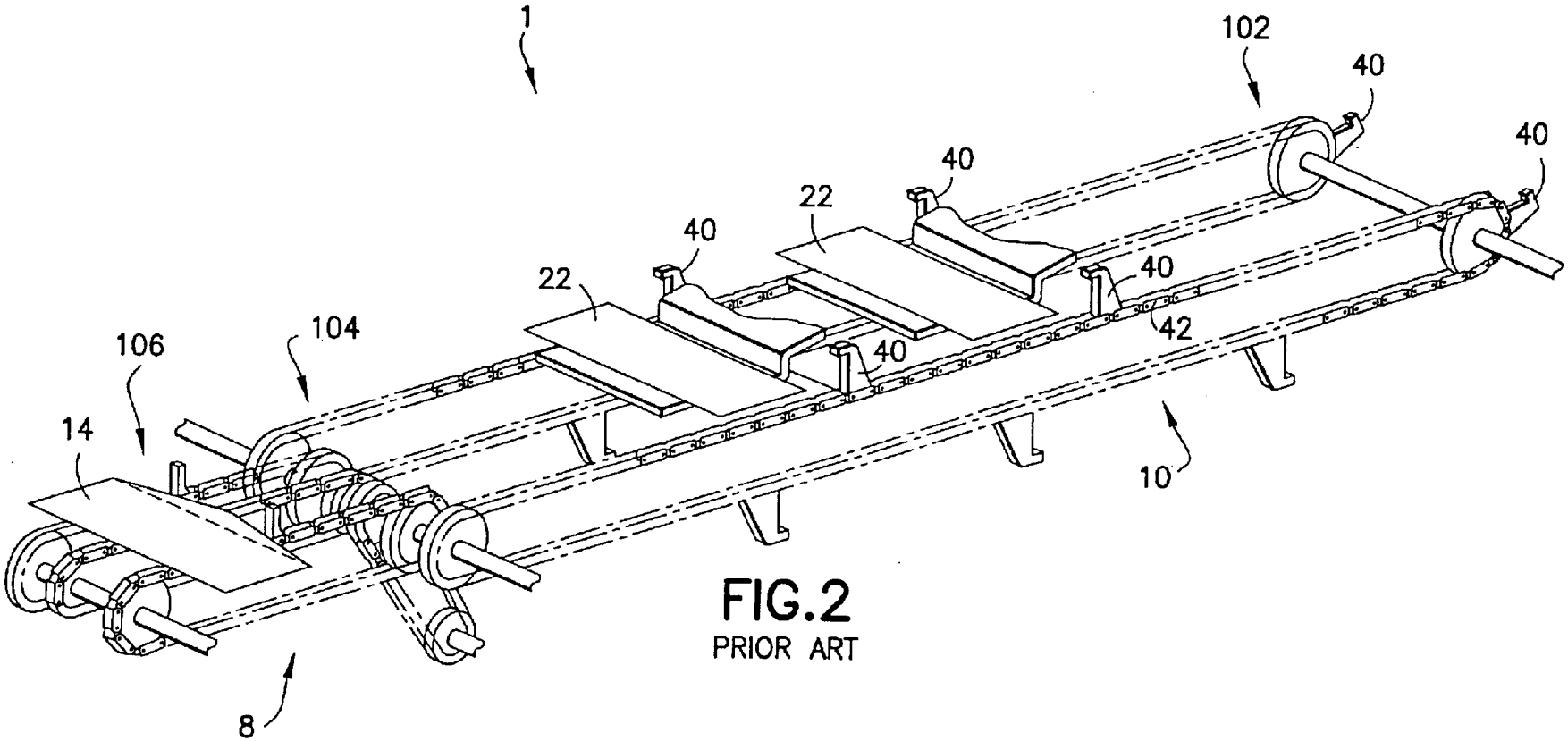
FIG.2 PRIOR ART
FIG. 2 is a schematic representation showing the pusher fingers and the belts in the mail inserting system.
Figure 5A:
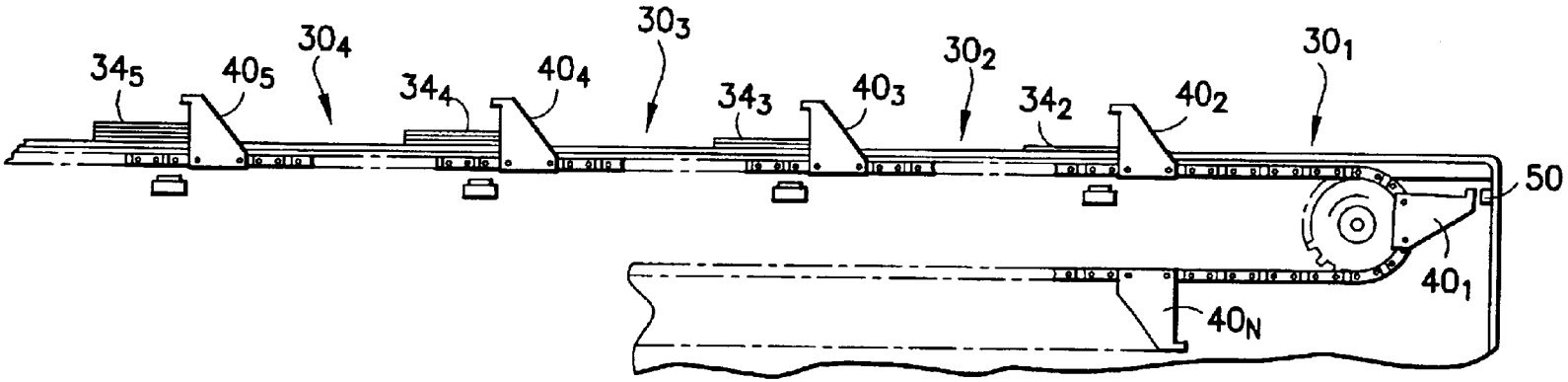
FIG. 5*a* is a schematic representation showing the normal operation of the mail inserting system, according to the present invention.
Figure 5B:
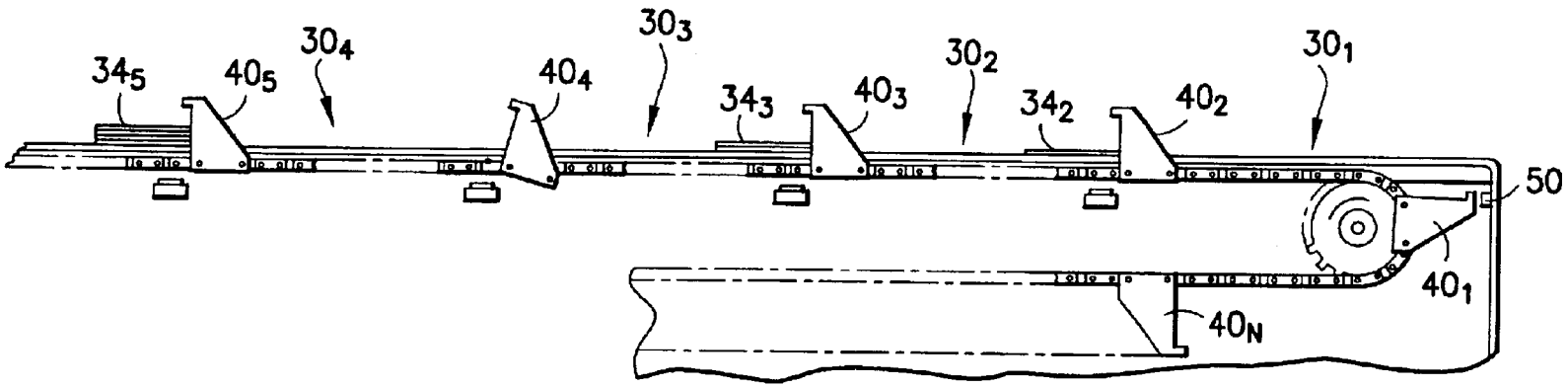
FIG. 5*b* is a schematic representation showing the operation of the mail inserting system when a pair of pusher fingers is non-functional.

It should be noted that, as shown in FIG. 3, each enclosure feeder 20 has a tray 28 onto which the document 22 is released so as to allow an approaching pusher finger pair 40 to push the released document 22 off the tray 28 onto the top of the documents 22 gathered upstream. However, in some mail inserting systems, each of the enclosure feeders 20 releases a document 22 directly to the moving belts 42 or the surface of the deck 26 so that the released document 22 falls on top of the documents gathered upstream. In general, the section of the belts 42 onto which an enclosure feeder 20 releases a document 22 is referred to as a pocket 30. As shown in FIGS. 5*a* and 5*b*, each pusher finger pair 40 has a pocket 30 directly in front of the pusher finger pair 40. If there are N pusher finger pairs 40 disposed on the belts 42, then there are N pockets 30 for containing N stacks 34 of collated documents 22 to be conveyed to the envelope insertion section 8 (FIGS. 1 and 2) per cycle. It is also understood that the number of enclosure feeders 20 that are actually used in a mail inserting system 1 depends on the number of documents 22 to be inserted in an envelope 14. For example, if M enclosure feeders 20 are actually used in a mail operation, then each pusher finger pair 40 will pass by each of the M enclosure feeders 20, one at a time. Since each enclosure feeder 20 only releases a document 22 to a passing pusher finger pair 40, each pocket 30 will receive one more document 22 than the immediately following pocket 30 until the following pocket 30 receives M documents 22. Thus, in normal operation, as shown in FIG. 5*a*, the pocket $\mathbf{30}_3$ has two documents 22 gathered by the pusher finger pair $\mathbf{40}_3$, the pocket $\mathbf{30}_4$ has three documents gathered by the pusher finger pair $\mathbf{40}_4$, and the pocket $\mathbf{30}_5$ has four documents gathered by the pusher finger pair $\mathbf{40}_5$. By the time a pusher finger pair 40 has passed all M enclosure feeders 20, the pocket 30 in front of that pusher finger pair 40 will have M documents 22. However, if one of the pusher finger pairs 40 is not functioning properly, documents 22 will not be released into the corresponding pocket 30. For example, if the one or both pusher fingers 40 of the pusher finger pair $\mathbf{40}_4$ is broken, missing or crooked, as shown in FIG. 5*b*, the pocket $\mathbf{30}_4$ will not receive any documents 22 from the M enclosure feeders 20 actually used in the mail inserting system 1. Nevertheless, the pocket $\mathbf{30}_3$ has two documents 22 gathered by the pusher finger pair $\mathbf{40}_3$, the pocket $\mathbf{30}_5$ has four documents 22 gathered by the pusher finger pair $\mathbf{40}_5$, etc. As such, except for the non-functioning pusher finger pair $\mathbf{40}_4$, each of all other pusher finger pairs 40 will gather and collate M documents 22 as normal. Thus, although the pusher finger pair $\mathbf{40}_4$ is defective, it will not cause paper jams. So long as the defective pusher finger pair 40 does not render the entire mail inserting system 1 inoperable, the throughput of the mail operation is only slightly reduced. Without unnecessarily removing the machine from operation, the goal of uninterrupted machine availability can be achieved.

It is advantageous to link an alarm system 80 to the sensor signal processor 60. When a pusher finger pair 40 is found to be defective, the sensor signal processor 60 sends a signal 164 to the alarm 80 to notify the operator of the problem in the mail inserting system 1. If the operator decides that the defective pusher finger pair 40 does not impair the operation of the mail inserting system 1, the operator may reset the alarm 80 and keep the mail inserting system 1 running. The alarm 80 remains off unless the sensing device 50 detects a new problem.

Figure 6:
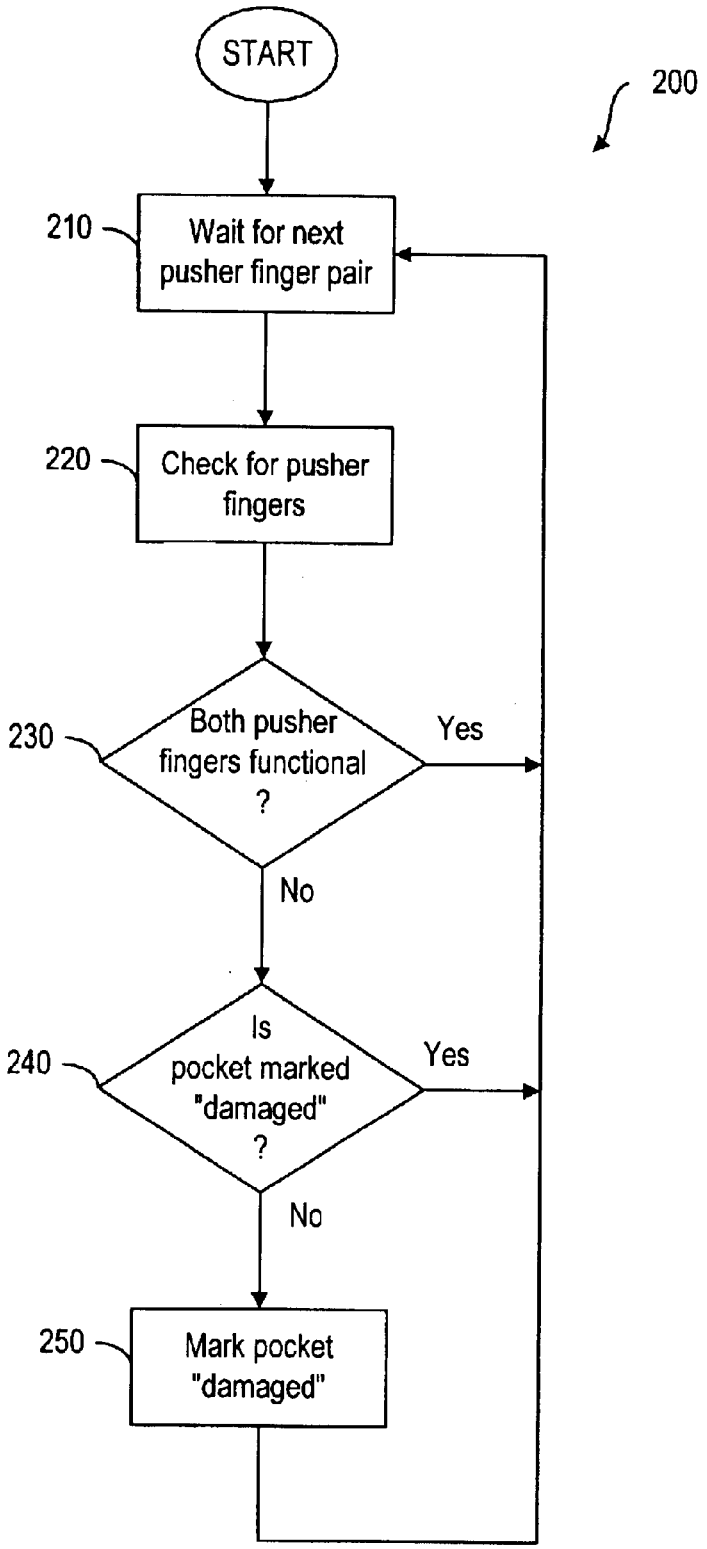
FIG. 6 is a flowchart showing the steps in detecting the non-functioning pusher fingers.
Figure 7:
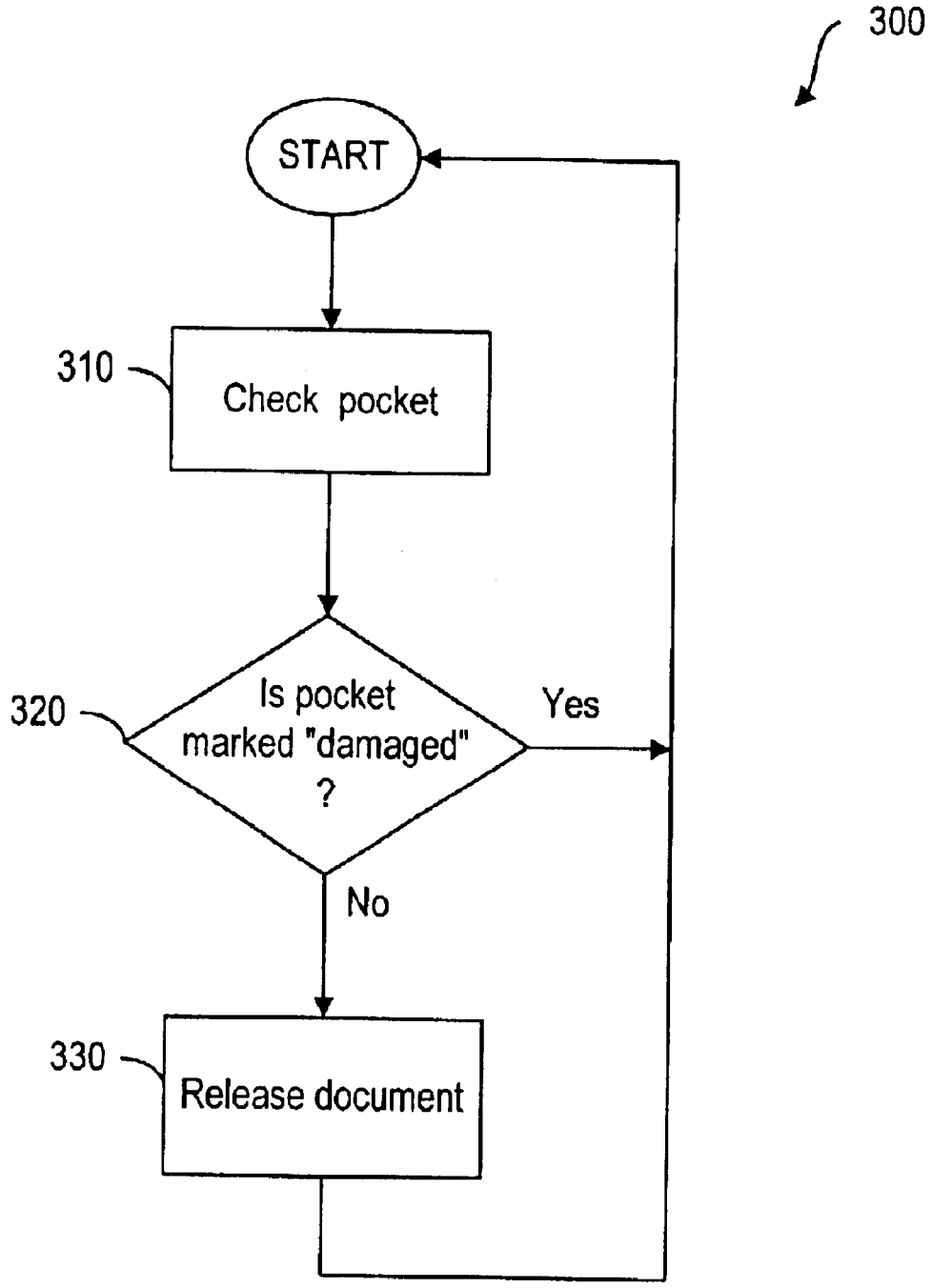
FIG. 7 is a flowchart showing the steps in controlling the release of enclosure documents, according to the present invention.

The software program 62 consists of two parts, as illustrated in FIGS. 6 and 7. FIG. 6 is a flowchart 200 showing the steps in detecting the non-functioning pusher fingers 40. After the mail inserting system 1 is turned on for mailing operation, the software program 62 waits for the next pusher finger pair 40 to arrive at the sensing device 50 at step 210. When the pusher finger pair 40 passes the sensing device 50, the software program 62 checks the position of the pusher finger pair 40 at step 220, based on the sensor signal 150 from the sensing device 50. At step 230, if it is determined that both pusher fingers of the passing pair 40 are normal, then the process is looped back to step 210 where the software program 62 waits for the next pusher finger pair 40. If, however, one or both push fingers 40 are found to be faulty, the pocket 30 associated with the faulty pusher finger pair 40 will be marked at step 250 as "damaged" if the pocket 30 has not been so marked. But if the associated pocket 30 is already marked "damaged", as determined at step 240, the process is directly looped back to step 210 because the defect is an old problem. The marking of the pockets 30 is directly linked to the releasing of documents 22 by each of the enclosure feeders 20. As shown in the flowchart 300 of FIG. 7, after the mailing operation has started, the software program 62 will check, at step 310, each pocket 30 as its associated pusher finger pair 40 approaches an enclosure feeder 20. At step 320, if it is determined that the pusher finger pair 40 is non-functional because the associated pocket 30 is marked "damaged", the software program 62 will disable the rollers 24 of the enclosure feeder 20, preventing them from releasing a document 22 onto the pocket 30. Otherwise, the enclosure feeder 20 releases a document 22 onto the pocket 30 at step 330 and the process is looped back to step 310.

The collation section 10 and the feeders 20 have been described in conjunction with a mail insertion system 1 where the feeders are used to release enclosure materials so that the released enclosed materials are collated and conveyed to an envelope insertion section 8 (FIG. 1) for insertion. It should be understood that the same collation section and feeders can be used to release and collate any flat items such as paper documents for distribution without being inserted into envelopes for mailing.

Although the invention has been described with respect to a preferred embodiment thereof, it will be understood by those skilled in the art that the foregoing and various other changes, omissions and deviations in the form and detail thereof may be made without departing from the scope of this invention.

What is claimed is:

1. A collation system for collating generally flat items, comprising:

an upstream end;

a downstream end;

a deck extending from the upstream end to the downstream end;

a plurality of feeders, each positioned relative to the deck so as to be able to release the items onto the deck;

a continuous moving member running from the upstream end toward the downstream end;

a plurality of pusher pairs mounted on the moving member, each pair disposed in a pre-determined position and associated with a section of the moving member in front of said pair for pushing from the upstream end to the downstream end the items released into said section by the feeders;

a sensing mechanism to determine whether a pusher pair is functional; and a controller coupled to the sensing mechanism and controlling the feeders to release the items only onto the sections of the moving member associated with functional pusher pairs.

2. The collation system of claim 1, wherein the flat items comprise enclosure materials to be used in a mail inserting machine for envelope insertion.

3. The collation system of claim 1, wherein the flat items comprise input documents.

4. The collation system of claim 1, wherein the sensing mechanism comprises photo-sensors.

5. The collation system of claim 1, wherein the continuous moving member comprises a pair of belts running side-by-side along the deck from the upstream end toward the downstream end, each pusher pair comprises two pusher fingers, each of which is mounted on a different one of the belts, each pusher finger has a forward facing edge, and the sensing mechanism senses the edge for determining whether said each pusher pair is functional.

6. The collation system of claim 5, wherein the sensing mechanism comprises two pairs of photo-sensors, each pair of photo-sensors disposed on two sides of each belt.

7. The collation system of claim 5, wherein the sensing mechanism provides a signal indicative of whether the pusher pair is functional, said collation system further comprising a signal processor, responsive to the signal, for marking each section of the moving member to indicate whether the pusher pair associated with said each section is functional, and whereby the controller controls the releasing of the items onto said each section according to said marking.

8. The collation system of claim 7, further comprising an alarm system, responsive to the signal, for notifying an operator when any of the pusher pairs is non-functional.

9. A method of improving the performance of a collation system for collating generally flat items, wherein the collation system comprises:

an upstream end;

a downstream end;

a deck extending from the upstream end to the downstream end;

a plurality of feeders positioned relative to the deck so as to be able to release the items onto the deck;

a continuous moving member running from the upstream end toward the downstream end;

a plurality of pusher pairs mounted on the moving member, each pair disposed in a pre-determined position and associated with a section of the moving member in front of said pair for pushing from the upstream end to the downstream end the items released into said section by the feeders, said method comprising the steps of:

sensing the position of the pusher pairs;

determining whether the pusher pairs are functional as to said pushing based on the sensed positions;

releasing the items only onto the sections of the moving member associated with functional pusher pairs;

marking the sections to indicate whether the sections are functional so that the releasing of the items is based on said marking.

10. A mail inserting system for inserting enclosure materials into envelopes for mailing, said system comprising:

an envelope insertion section for providing the envelopes for insertion;

a collation section for collating the enclosure materials, the collation section having:

an upstream end, a downstream end adjacent to the envelope insertion station, a deck extending from the upstream end to the downstream end, a plurality of feeders, each positioned relative to the deck so as to be able to release the enclosure materials onto the deck, a continuous moving member running from the upstream end toward the downstream end, and a plurality of pusher pairs mounted on the moving member, each pair disposed in a pre-determined position and associated with a section of the moving member in front of said pair for pushing from the upstream end to the downstream end the enclosure materials released into said section by the feeders so as to convey the pushed enclosure materials to the envelope insertion section for insertion; and a sensing mechanism, positioned relative to the deck of the collation section, to determine whether a pusher pair is functional;

a controller coupled to the sensing mechanism and controlling the feeders to release the enclosure materials only on the sections of the moving member associated with functional pusher pairs.

11. The mail inserting system of claim 10, wherein the sensing mechanism comprises photo-sensors.

12. The mail inserting system of claim 10, wherein the continuous moving member comprises a pair of belts running side-by-side along the deck from the upstream end toward the downstream end, each pusher pair comprises two pusher fingers, each of which is mounted on a different one of the belts, each pusher finger has a forward facing edge, and the sensing mechanism senses the edge for determining whether said each pusher pair is functional.

13. The mail inserting system of claim 12, wherein the sensing mechanism comprises two pairs of photo-sensors, each pair of photo-sensors disposed on two sides of each belt.

* * * * *